US005521341A

United States Patent [19]

Stief et al.

[11] Patent Number: 5,521,341

[45] Date of Patent: May 28, 1996

[54] SOUND-ATTENUATOR

[75] Inventors: Reinhard Stief, Weinheim; Manfred Mattutat, Ladenburg, both of Germany

[73] Assignee: Firma Carl Freudenberg, Weinheim, Germany

[21] Appl. No.: 248,922

[22] Filed: May 25, 1994

[30] Foreign Application Priority Data

May 28, 1993 [DE] Germany ..... 43 17 828.6

[51] Int. Cl.[6] ..... E04B 1/82

[52] U.S. Cl. ..... 181/295

[58] Field of Search ..... 181/284, 286, 181/287, 288, 291, 294, 295, 30, 207, 208, 209; 52/144, 145

[56] References Cited

U.S. PATENT DOCUMENTS 2,796,636 6/1957 Heerwagen ..... 52/144
4,149,612 4/1979 Bschorr ..... 181/286
4,228,869 10/1980 Bschorr ..... 181/286
4,393,631 7/1983 Krent ..... 52/144
4,425,981 1/1984 Kiesewetter et al. ..... 181/286

FOREIGN PATENT DOCUMENTS 3412432 10/1985 Germany .

*Primary Examiner*—Khanh Dang
*Attorney, Agent, or Firm*—Kenyon & Kenyon

[57] ABSTRACT

An airborne-sound-absorbing shaped component is disclosed. The element comprises at least two chambers that are arranged adjacent to one another in the direction of the vibrations that are to be introduced into the system. These chambers help delimit a shared cavity that is hermetically sealed with respect to the environment which also operates as a pneumatic spring. Each of the chambers is delimited by a delimiting wall made of a polymer material, the delimiting walls being configured integrally and continuously with one another and joined to one another in a transition region, in a manner allowing relative movement by at least one spring element that is resilient in the direction of the introduced vibrations.

17 Claims, 5 Drawing Sheets

SOUND-ATTENUATOR

BACKGROUND OF THE INVENTION

This invention generally concerns a device having a sound-absorbing shape for reducing atmospherically transmitted noise, and particularly one of the type comprising at least two substantially cup-shaped chambers that are arranged adjacent to one another in the direction of the vibrations that are introduced into the device. In devices of this type, the chambers delimit a shared cavity, hermetically sealed with respect to the environment, that is configured as a pneumatic spring.

A shaped device of this kind is known from German Patent 34 12 432. The sound-absorbing component of this reference is designed as a Helmholtz resonator, in which partial spaces are enclosed by cup elements joined to one another via a neck-shaped opening in the bottom of the inner cup element. To improve sound absorption, provision is made for the bottom of the inner cup element to be made of a plastic film, the remaining parts of the shaped component being made of metallic material, in particular a metal foil. Sound attenuators constructed according to the German patent have proven to be less than satisfactory in terms of their cost and production engineering. The cup elements must each be generated separately from one another and subsequently assembled to one another. Problems are encountered in tuning the largely metallic cup elements to the vibration being isolated.

There remains a need to further develop a sound attenuator that can be manufactured more easily and cost-effectively, and that provides improved absorption of atmospherically transmitted sound across a broader frequency range.

SUMMARY OF THE INVENTION

The present invention meets this need by providing a sound attenuator comprising first and second chambers that define a shared, pneumatic spring-like cavity that is hermetically sealed against the environment.

Provision is made for each of the chambers of the sound attenuator to be delimited by a delimiting wall made of a polymer material. The delimiting walls are configured integrally and continuously with one another, and are joined to one another in a transition region in a manner that permits the relative movement of at least one resilient spring element in the direction of the vibrations. The attenuator is molded, and can therefore be manufactured particularly easily in a one-piece configuration. By utilizing a polymer material, one obtains good utilization characteristics of the attenuator, so that it can be used in such challenging environments as those that are moist or dusty. Because the element has a smooth surface with no recesses, a shaped component of this kind is easy to clean and can even be used when perfectly hygienic conditions are essential, for example in the medical field or in the food-processing industry.

The attenuator comprises a spring-and-mass system in which the spring is of the compound type, consisting of both the air enclosed within the shared cavity and the resilient spring-like material, which also functions as the transition region between the delimiting walls delimiting the chambers. This springy transition zone permits relative movement between the delimiting walls. The spring element, proceeding from the delimiting walls adjacent on either side of it, possesses a steplessly continuously reduced thickness of membrane-like thinness. The mass of the system is provided by the delimiting wall itself. The absorption characteristics of the chamber or cavity defined therein can be adjusted by proper selection of the configuration of the spring element. In particular, the spring characteristics of the sound dampener depend primarily on the material thickness, stiffness, and configuration of the spring element, as well as the size of the sealed cavity.

By employing a spring element made of a polymer and has a membrane-like thinness, one obtains an extraordinarily flexible attachment of the delimiting wall, facilitating the desired relative vibrations within the device. The transition area between the delimiting walls preferably is rounded in shape so as to provide good utilization characteristics over a long service life. By avoiding abrupt changes in cross sectional wall thickness, notch effects within the spring element can reliably be eliminated. These features help assure good operating characteristics, even after many load cycles. The cross section of the spring element can taper in an X-shape between the delimiting walls so as to produce progressive spring characteristics. This structure provides outstanding vibration insulation across a broad frequency range.

According to one embodiment, the material thickness of the spring element can be between 0.1 to 0.05 times as great as the material thickness of the delimiting walls in the attachment region. Consequently, when air-borne sound strikes the delimiting wall (which is capable of relative movement), only the spring element in the transition region between the mutually adjacent delimiting walls is actually deformed. No appreciable deformation occurs in the delimiting wall, which is configured to be largely dimensionally stable.

In another embodiment, the delimiting walls are joined by a stepped spring element comprising at least one step. To achieve a specific spring constant, the step can possess any shape; to provide tuning to the broadest possible frequency range, the delimiting wall capable of relative movement is configured as a cover, and is coupled to the fixed chamber region of the second delimiting wall. This embodiment, which utilizes a stepped spring element consisting of a plurality of steps, is especially advantageous in absorbing vibrations of the lowest possible frequency range.

Where low frequencies are to be absorbed, it has proven to be advantageous to use a spring element that is configured like a corrugated diaphragm. With this spring element embodiment, vibratory relative motion of the two delimiting walls with respect to one another causes only a slight level of mechanical flexing stress, which affords significant advantages in providing a good service life. The material thickness of the polymer material is reduced in the transition region between the two delimiting walls. The resiliency of the spring element again depends on its shape, the material thickness, and the material itself.

One of the delimiting walls can be provided with an integrally shaped-on mounting flange. The mounting flange, which is arranged on the side of the shaped component facing away from the sound to be muffled, can be joined in a sealed manner to a building ceiling. Sealed joining of the shaped component to a supporting element is necessary in order to enhance the effect of the spring element. The enclosed air and the spring element are arranged functionally arrayed to behave as parallel springs. The site of the mounting flange facing away from the cavity can be provided with an integrally shaped-on sealing lip which peripherally surrounds the cavity. This substantially simplifies sealing with respect to the retaining element which receives the shaped component.

A plurality of attenuators can also be produced and installed in a linked fashion, each component absorbing a different frequency range.

According to a further advantageous embodiment, provision can be made for the delimiting wall facing the sound to have an at least partially flat surface. Particularly effective sound absorption occurs in this embodiment when the sound pressure of the acoustically disturbing vibrations strikes the flat surface substantially perpendicularly.

According to another embodiment, the delimiting wall can have domed surface. This is advantageous in that the incoming sound can strike the surface omnidirectionally and yet be absorbed almost equally well. This embodiment has proven especially advantageous when the sound source is movable with respect to the shaped component, or where the sound arises, from a plurality of sound sources and yet must be absorbed by the same shaped component.

In order to absorb the broadest possible band of sound, the delimiting wall facing the airborne sound can comprise at least two segments, vibrationally decoupled from one another, that are configured integrally and continuously with one another. The segments possess a shape and/or mass which differ from one another. The frequencies that can be absorbed by this kind of shaped component can, for example, be directly adjacent to one another, resulting, for example, in a broad frequency range. The segments can also be tuned to one another so that two relatively tightly delimited frequency ranges, spaced apart from one another, can be absorbed.

DETAILED DESCRIPTION

Figure 1:
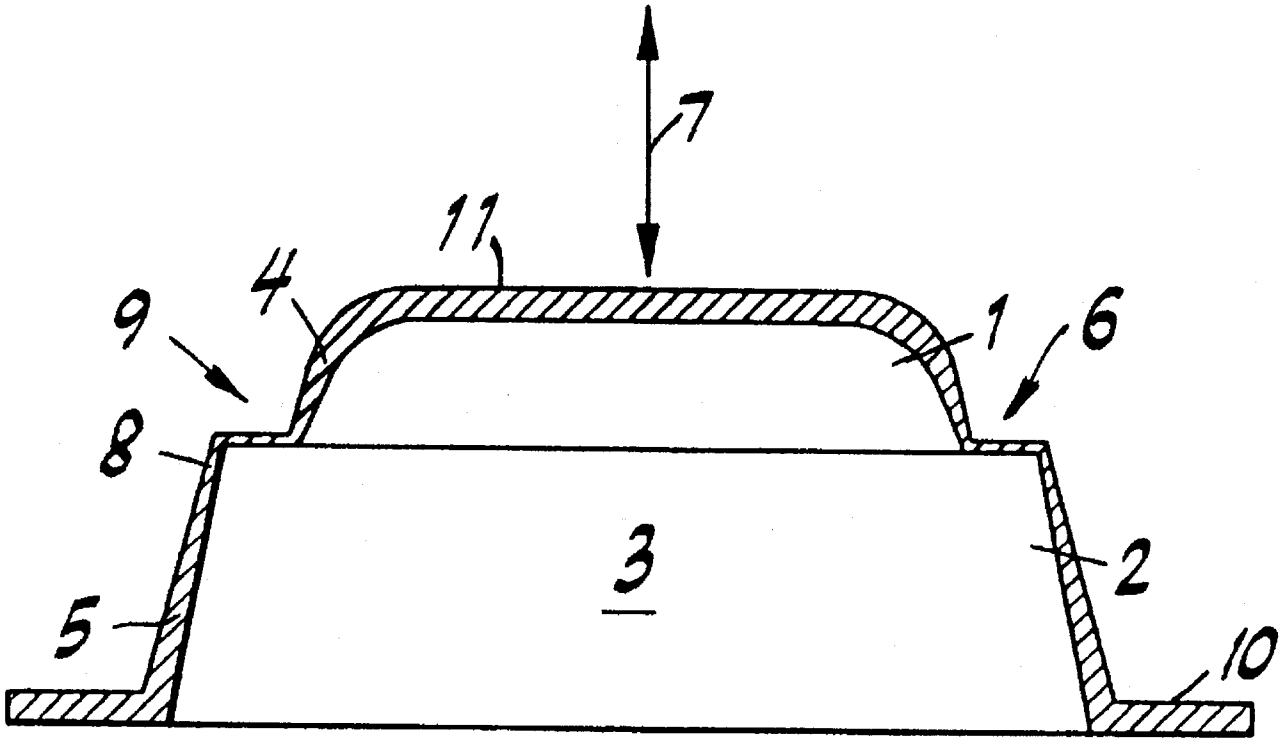
FIG. 1 is a cross-sectional view of a first embodiment of the shaped component constructed according to the principles of the invention, in which the cover is capable of relative movement and has a rounded shape in the region of its delimitations.

FIGS. 1 to 4 illustrate a number of embodiments of a sound attenuator that comprises two chambers 1 and 2 of any shape arranged adjacent to one another in the axial direction. Chambers 1 and 2 are delimited by delimiting walls 4 and 5, which are made of a polymer material. The shaped component is configured so that the two delimiting walls merge integrally and continuously with one another. The integral and continuous delimiting walls 4 and 5 of the two chambers 1 and 2 are joined together through a transition region 6 via a spring element 8 in a manner capable of supporting vibration and relative movement. The spring element 8 is resilient in the direction of the introduced vibrations 7. Delimiting wall 5 enclosing second chamber 2 is provided with an integrally shaped-on mounting flange 10 that is fastened in a sealed manner to an underlying supporting element (not shown). Cavity 3 is thus seen to be formed by delimiting walls 4 and 5, and the supporting element. When used as intended, the cavity behaves as an air spring, arranged in parallel with the resilient spring element 8.

In the embodiment illustrated in FIG. 1, spring element 8 includes a step 9 that joins delimiting walls 4 and 5 to one another. Proceeding from delimiting walls 4 and 5, spring element 8 has a substantially thinner material thickness so as to provide a resilient zone of attachment of the two delimiting walls 4 and 5 to one another. Delimiting wall 4 is functionally configured to behave as a vibrating cover and as the mass of the spring-and-mass system. It has a rounded cross section. The material thickness and/or size of the cover, and thus the mass of the delimiting wall 4, is selected in dependence upon the frequency range of vibration that is to be absorbed.

Figure 2:
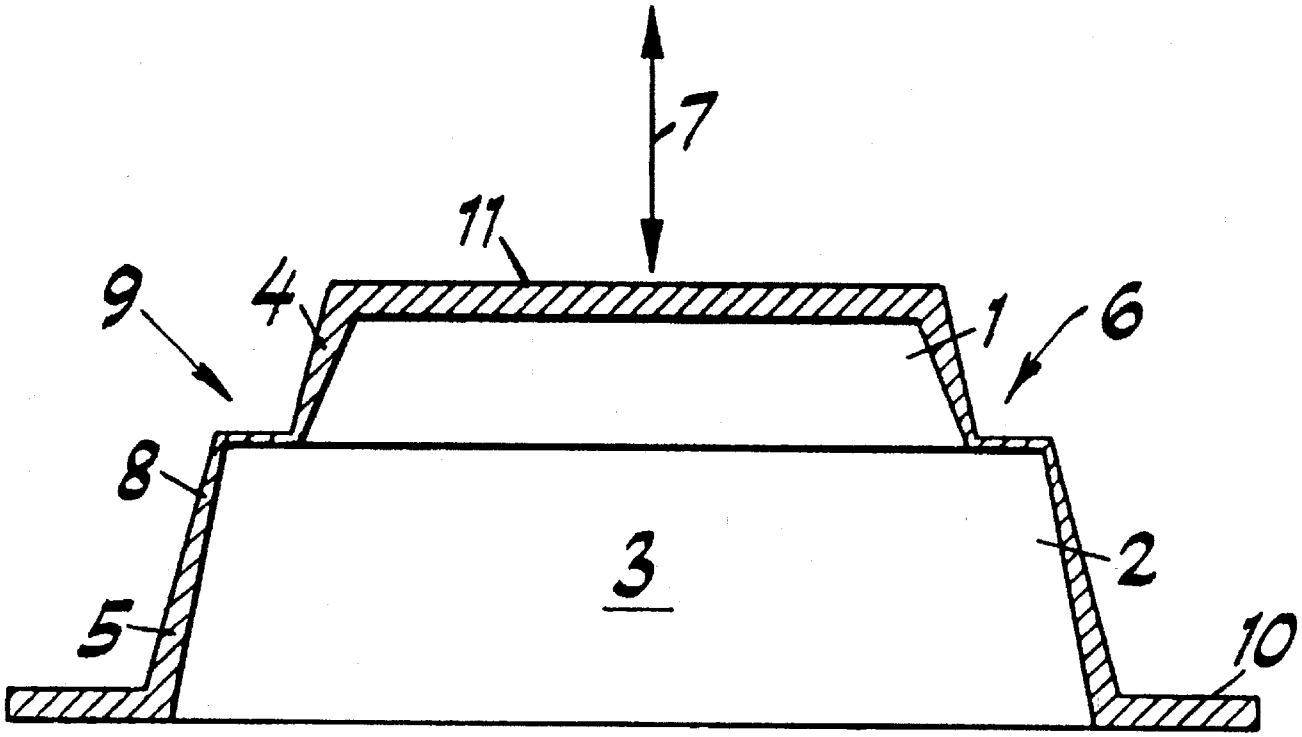
FIG. 2 provides a similar view of a second embodiment, in which the movable delimiting wall has a sharp-edged shape in its edge region.

FIG. 2 shows a second embodiment that corresponds substantially to the first embodiment. However, in contrast to the delimiting wall 4 of FIG. 1 that is configured as a rounded cover, the cover here is delimited by a sharp edge. The thickness of both delimiting walls 4 and 5 tapers down continuously toward each other in the direction of the spring element 8, so that excursion of the first delimiting wall 4 with respect to the second delimiting wall 5 provides a progressive spring characteristic that facilitates the absorption of a broad range of sound frequencies.

Figure 3:
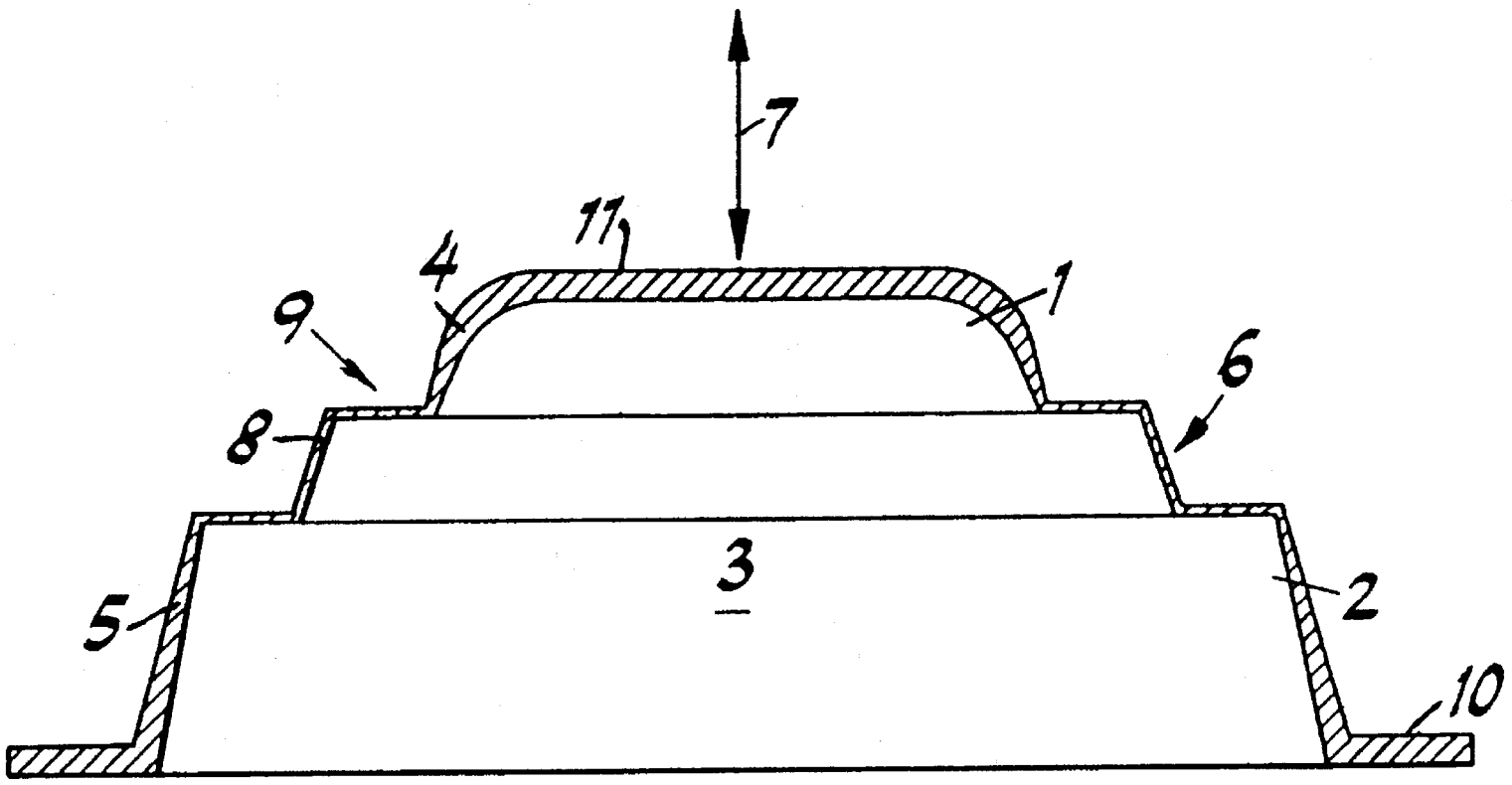
FIG. 3 is a cross-sectional view of a third embodiment, in which the delimiting wall is capable of relative movement and forms the cover, and is attached via a two-step attachment to the adjacent delimiting wall.

In FIG. 3, the two delimiting walls 4 and 5 are joined to one another in two steps. Spring element 8, with its two-step configuration, produces a broader-band sound absorption and longer spring travel as compared with the two previous embodiments, which is advantageous for the absorption of low frequencies.

Figure 4:
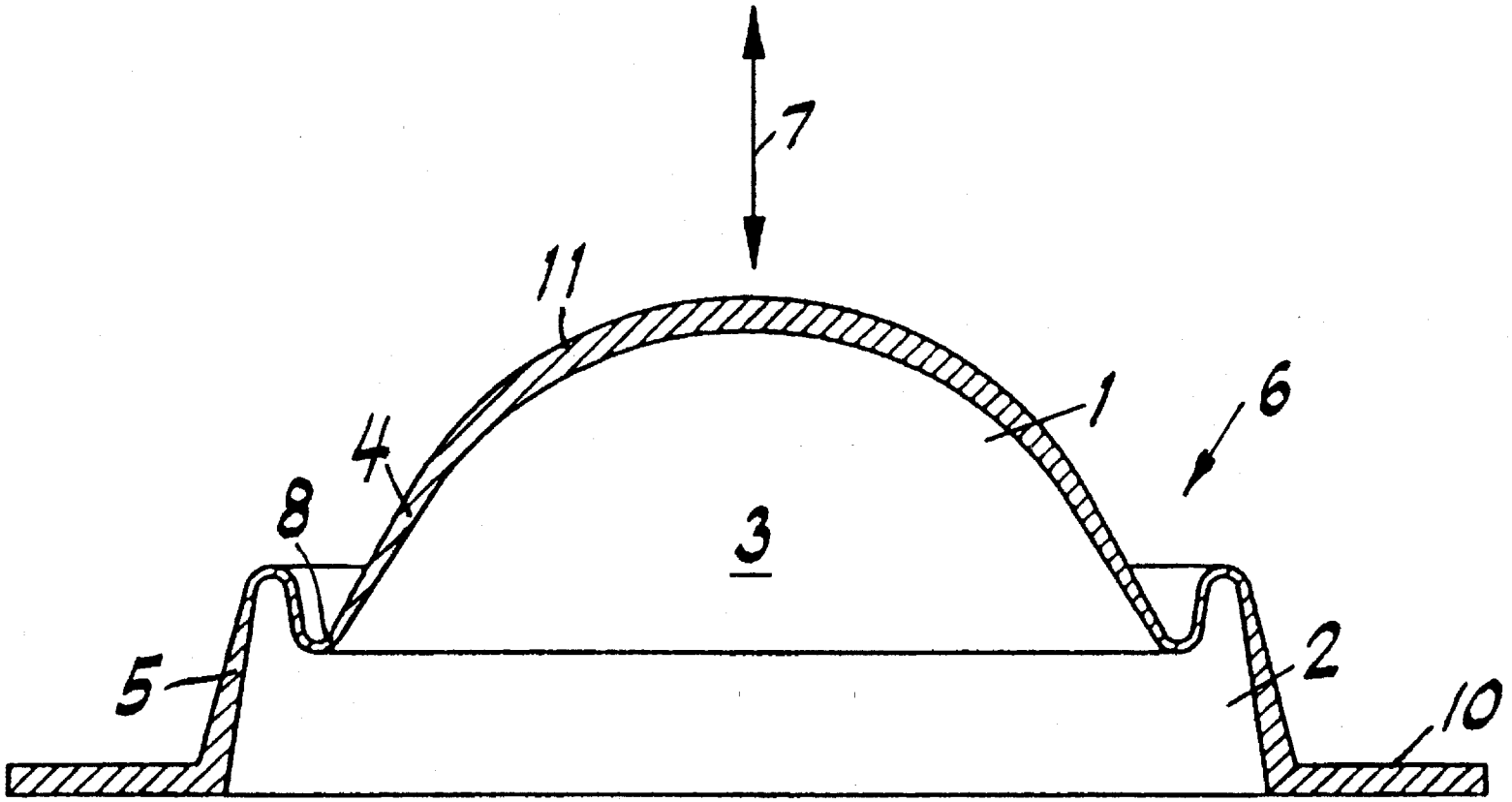
FIG. 4 illustrates a fourth embodiment in which the cover has, a dome-shape, the cover being joined in a transition region to the adjacent delimiting wall by means of a spring element resembling a corrugated diaphragm.

In FIG. 4, spring element 8 is configured like a corrugated diaphragm. The spring element 8 joins the first delimiting wall 4, which has a rounded dome shape, to the second delimiting wall, which is provided with mounting flange 10. The material thickness of this integrally and continuously shaped component produces a limitation of the excursion movement of the two delimiting walls 4 and 5 with respect to one another. Spring element 8 is provided with an increasing material thickness on either side in the direction of the adjacent delimiting walls 4, 5, and is therefore less resilient in these regions. This embodiment allows good absorption of sound arriving from different directions.

Figure 5:
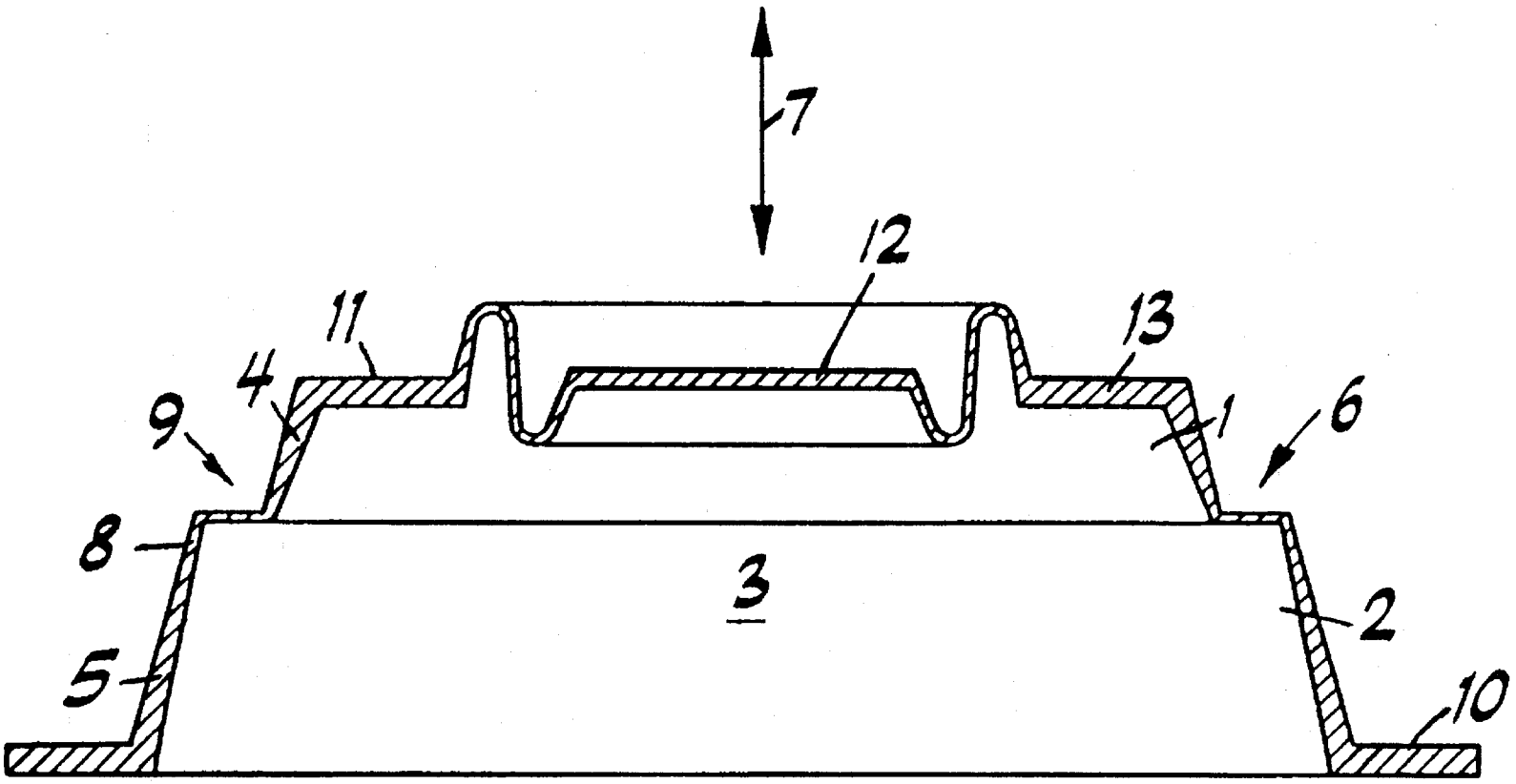
FIG. 5 shows a fifth embodiment in which the cover possesses two vibrationally decoupled segments of differing mass.

FIG. 5 illustrates another embodiment of the attenuator, in which the first delimiting wall comprises two segments 12 and 13 having different masses. A structural element of this kind can absorb sound in a broad frequency range or in two frequency ranges separated from one another. In the embodiment shown here, both a stepped spring element (connecting walls 4 and 5) and a spring element configured like a corrugated diaphragm (linking segments 12 and 13) are used, functionally arranged in series with one another.

What is claimed is:

1. A sound attenuator, comprising:

a first chamber and a second chamber axially overlying the first chamber, said chambers defining a shared cavity that is hermetically sealable against the environment, wherein the shared cavity functions as a pneumatic spring;

first and second polymeric delimiting walls made of a material that is capable of supporting a hermetic seal, said delimiting walls defining at least a portion of the first and second chambers respectively, said first and second delimiting walls smoothly merging into one another; and a spring linking the first and second delimiting walls for permitting the displacement of the chambers with respect to each other in a direction corresponding to the direction from which sound arrives.

2. A sound attenuator, comprising:

a first chamber and a second chamber axially overlying the first chamber, said chambers defining a shared cavity that is hermetically sealed against the environment, wherein the shared cavity functions as a pneumatic spring;

first and second polymeric delimiting walls defining at least a portion of the first and second chambers respectively, said first and second delimiting walls smoothly merging into one another; and a spring linking the first and second delimiting walls for permitting the displacement of the chambers with respect to each other in a direction corresponding to the direction from which sound arrives;

wherein facing portions of the delimiting walls define a transition region having a steplessly continuously reduced thickness of membrane-like thickness relative to the delimiting walls on either of its sides, said transition region having an elasticity which enables it to function as the spring element.

3. A sound attenuator according to claim 2, wherein the spring has a material thickness that is 0.1 to 0.05 times as great as the thickness of the delimiting walls.

4. A sound attenuator according to claim 1, wherein the spring linking the delimiting walls is stepped and comprises at least one step.

5. A sound attenuator according to claim 2, wherein the spring linking the delimiting walls is stepped and comprises at least one step.

6. A sound attenuator, comprising:

a first chamber and a second chamber axially overlying the first chamber, said chambers defining a shared cavity that is hermetically sealed against the environment, wherein the shared cavity functions as a pneumatic spring;

first and second polymeric delimiting walls defining at least a portion of the first and second chambers respectively, said first and second delimiting walls smoothly merging into one another; and a spring configured in the shape of a corrugated diaphragm, said spring linking the first and second delimiting walls for permitting the displacement of the chambers with respect to each other in a direction corresponding to the direction from which sound arrives.

7. A sound attenuator according to claim 2, wherein the spring is configured in the shape of a corrugated diaphragm.

8. A sound attenuator according to claim 3, wherein the spring is configured in the shape of a corrugated diaphragm.

9. A sound attenuator according to claim 1, further comprising amounting flange that is integrally shaped onto one of the delimiting walls.

10. A sound attenuator according to claim 2, further comprising amounting flange that is integrally shaped onto one of the delimiting walls.

11. A sound attenuator according to claim 4, further comprising amounting flange that is integrally shaped onto one of the delimiting walls.

12. A sound attenuator according to claim 1, wherein one of the delimiting walls comprises an at least partially flat surface.

13. A sound attenuator according to claim 2, wherein one of the delimiting walls comprises an at least partially flat surface.

14. A sound attenuator, comprising:

a first chamber and a second chamber axially overlying the first chamber, said chambers defining a shared cavity that is hermetically sealed against the environment, wherein the shared cavity functions as a pneumatic spring;

first and second polymeric delimiting walls defining at least a portion of the first and second chambers respectively, said first and second delimiting walls smoothly merging into one another; and a spring linking the first and second delimiting walls for permitting the displacement of the chambers with respect to each other in a direction corresponding to the direction from which sound arrives, wherein one of the delimiting walls comprises at least two segments, vibrationally decoupled from one another, that are configured integrally and continuously with one another, and wherein the segments differ in mass from each other.

15. A sound attenuator according to claim 2, wherein one of the delimiting walls comprises at least two segments, vibrationally decoupled from one another, that are configured integrally and continuously with one another, and wherein the segments differ in mass from each other.

16. A sound attenuator, comprising an axially symmetrical shell having first and second portions, said shell portions defining first and second hermetically sealed chambers which meet at a junction, said chambers acting in parallel with the spring action of the elastically deformable region of the shell as a pneumatic spring when disturbed by acoustic vibrations;

said shell including a region of reduced thickness at the junction of the two chambers, whereby the region of reduced thickness is elastically deformable in the direction of the axis of symmetry of the shell so as to provide spring action thereat; and a plurality of serially linked spring elements interposed between and linking the first and second chambers together so that they may be axially deformed with respect to one another in response to an acoustic disturbance.

17. A sound attenuator as in claim 16, wherein the attenuator is molded as one piece.

* * * * *

UNITED STATES PATENT AND TRADEMARK OFFICE

CERTIFICATE OF CORRECTION

PATENT NO. : 5,521,341

DATED : 28 May 1996

INVENTOR(S) : Reinhard STIEF et al.

It is certified that error appears in the above-indentified patent and that said Letters Patent is hereby corrected as shown below:

| Column | Line | |
|---|---|---|
| 5 | 59 | Change "amounting" to --a mounting--. |
| 6 | 2 | Change "amounting" to --a mounting--. |
| 6 | 5 | Change "amounting" to --a mounting--. |

Signed and Sealed this

Twelfth Day of November, 1996

Bruce Lehman

*Attest:*

BRUCE LEHMAN

*Attesting Officer*

*Commissioner of Patents and Trademarks*